US010900662B2

(12) United States Patent
Wu et al.

(10) Patent No.: US 10,900,662 B2
(45) Date of Patent: Jan. 26, 2021

(54) COMBUSTION MECHANISM

(71) Applicant: WUYI University, Guangdong (CN)

(72) Inventors: Min Wu, Guangdong (CN); Yan Zhou, Guangdong (CN)

(73) Assignee: WUYI University, Guangdong (CN)

( * ) Notice: Subject to any disclaimer, the term of this patent is extended or adjusted under 35 U.S.C. 154(b) by 90 days.

(21) Appl. No.: 16/389,674

(22) Filed: Apr. 19, 2019

(65) Prior Publication Data

US 2020/0300464 A1 Sep. 24, 2020

(51) Int. Cl.

| | |
|---|---|
| ***F23G 5/12*** | (2006.01) |
| ***F23G 7/10*** | (2006.01) |
| ***F23G 5/44*** | (2006.01) |
| ***F23J 1/00*** | (2006.01) |

(52) U.S. Cl.

CPC ..... *F23G 5/12* (2013.01); *F23G 5/44* (2013.01); *F23G 7/10* (2013.01); *F23J 1/00* (2013.01); *F23G 2202/40* (2013.01); *F23G 2204/103* (2013.01); *F23G 2209/262* (2013.01); *F23J 2700/003* (2013.01)

(58) Field of Classification Search

CPC ..... F23G 5/12; F23G 7/10; F23G 5/44; F23G 2202/40; F23G 2209/262; F23G 2204/103; F23J 1/00; F23J 2700/003

See application file for complete search history.

(56) References Cited

U.S. PATENT DOCUMENTS

| | | | | |
|---|---|---|---|---|
| 3,974,784 A * | 8/1976 | Greenberg | B01D 53/34 588/314 |
| 4,470,358 A * | 9/1984 | Prochnow | F23G 5/027 110/206 |
| 5,237,938 A * | 8/1993 | Fujimori | F23G 5/12 110/190 |
| 5,865,130 A * | 2/1999 | Jamison | F23G 7/065 110/212 |
| 10,364,985 B2 * | 7/2019 | Geselle | F23G 5/08 |

* cited by examiner

*Primary Examiner* — David J Laux
(74) *Attorney, Agent, or Firm* — Farjami & Farjami LLP

(57) ABSTRACT

Disclosed is a combustion mechanism including a combustion chamber, an inner container arranged in the combustion chamber, the inner container is internally provided with a first igniter, a fire outlet pipe extending from an inner cavity of the inner container to outside of the combustion chamber, an ash discharge pipe above the inner container and extending to outside of the combustion chamber. The combustion mechanism further includes a feeding pipe extending into the inner container for feeding materials into the inner container; a nozzle in the inner container for blowing air to cause accumulated ash into the ash discharge pipe, and a first suction fan being arranged in the ash discharge pipe; a gas driving mechanism connected with the nozzle for outputting jet gas to the nozzle; and an air supply mechanism outside the combustion chamber for supplying air to the inner container and the gas driving mechanism.

18 Claims, 1 Drawing Sheet

COMBUSTION MECHANISM

FIELD

The disclosure relates to the technical field of crop treatment, in particular to a combustion mechanism.

BACKGROUND

A large amount of accumulated ash is generated in a combustion machine using the crops as combustion fuel, manual periodic shutdown is needed for cleaning, and the use efficiency is affected.

SUMMARY

The disclosure aims to solve at least one of the technical problems in the prior art, and provides a combustion mechanism capable of automatically cleaning accumulated ash in equipment.

According to an aspect of the disclosure, a combustion mechanism is provided including:

a combustion chamber;

an inner container arranged in the combustion chamber, the inner container being provided with:

a first igniter within the inner container, a fire outlet pipe extending from an inner cavity of the inner container to outside of the combustion chamber, an ash discharge pipe above the inner container and extending to outside of the combustion chamber;

a feeding pipe extending into the inner container for feeding materials into the inner container;

a nozzle in the inner container for blowing air to cause accumulated ash into the ash discharge pipe, and a first suction fan being arranged in the ash discharge pipe;

a gas driving mechanism connected with the nozzle for outputting jet gas to the nozzle; and an air supply mechanism outside the combustion chamber for supplying air to the inner container and the gas driving mechanism.

Advantageous effects: the air is driven into the inner container by the gas driving mechanism, so that the ash accumulated on the inner wall of the inner container falls off and is discharged out of the combustion chamber along the ash discharge pipe under the suction of the first suction fan.

In some embodiments, the air supply mechanism includes a second suction fan, and an air duct with one end communicated with the second suction fan and the other end extending into the inner container. The second suction fan draws air from the outside of the combustion chamber and provides oxygen for a second igniter of the inner container, and meanwhile. Furthermore, a portion of the air enters the gas driving mechanism to supply raw materials to the gas driving mechanism.

In some embodiments, the air supply mechanism includes several air ducts respectively with a solenoid valve. The amount of oxygen entering the inner container is controlled by opening or closing the solenoid valve so as to control the combustion fire intensity.

In some embodiments, the gas driving mechanism includes an air intake pipe, an acetylene intake pipe, a gas mixer, a second igniter and a pulse generator, the nozzle is mounted to the pulse generator, the air intake pipe and the acetylene intake pipe are respectively communicated with the gas mixer, the gas mixer is communicated with the second igniter, the second igniter is communicated with the pulse generator, and at least one of the air ducts is communicated with the air intake pipe. The acetylene and air are mixed by the gas mixer to form combustible gas, which enters the pulse generator after being ignited to form a strong-wave jet gas flow, and ash accumulated on the inner wall of the inner container is strongly vibrated and falls off.

In some embodiments, several pulse generators and several nozzles are provided. Several nozzles simultaneously jet gas flow to the ash on the inner container, so that the impact force is improved, and the ash sufficiently falls off.

In some embodiments, a heated net surface which abuts against the inner container is arranged in the combustion chamber, the inner container is provided with an ash discharge opening, an inclined guide groove is arranged below the heated net surface, the inclined guide groove is arranged below the ash discharge opening, an ash collection area with an opening and closing gate is arranged below the ash discharge opening. The remaining ash falls into the ash collection area along the guide rail, and the ash discharge opening is opened for treatment after production is finished.

BRIEF DESCRIPTION OF THE DRAWINGS

The disclosure is further illustrated by the following drawings and embodiments.

DETAILED DESCRIPTION OF THE EMBODIMENTS

Figure 1:
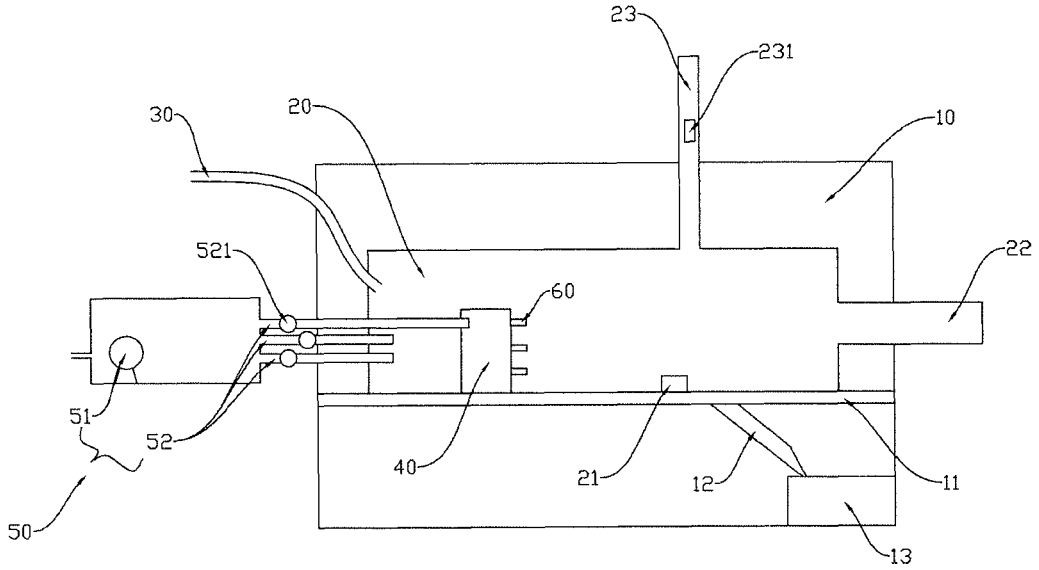
FIG. 1 is a structural schematic view of an embodiment of the disclosure.

The section will now describe the embodiments of the disclosure in detail, and preferred embodiment of the disclosure are illustrated in the accompanying drawings, which are intended to supplement, by way of illustration, the written description so as to enable a person to intuitively and vividly understand each technical feature and the overall technical solution of the disclosure, but is not to be construed as limiting the scope of the disclosure.

In describing the disclosure, it is to be understood that orientation terms, such as upper, lower, front, back, left, right, etc. indicate orientations or positional relationships, based on the orientation or positional relationships shown in the drawing for purposes of describing the disclosure and simplifying the description only, and are not intended to indicate or imply that the referenced device or element must have a particular orientation, and constructed and operated in the particular orientation, and therefore should not be construed as limiting the disclosure.

In the description of the disclosure, "several" means one or more, "a plurality of" means more than two; more than, less than, over, etc. are understood not to include the present number, and above, below, within, etc. are understood to include the present number. If "first" and "second" are described, they are only for the purpose of distinguishing technical features, and are not to be understood as indicating or implying relative importance or implicitly indicating the number of the indicated technical features or implicitly indicating the precedence relationship of the indicated technical features.

In the description of the disclosure, the words of arrangement, mounting, connection and the like are to be understood in a broad sense, unless otherwise defined. Those skilled in the art can reasonably ascertain the specific meaning of the above-mentioned words in the disclosure by combining the specific contents of the technical solutions.

Referring to FIG. 1, a combustion mechanism includes:

a combustion chamber 10; it should be mentioned that the combustion chamber 10 is capable of isolating the outside from the inside, preventing accidents from occurring;

an inner container 20 arranged in the combustion chamber 10, the inner container 20 is internally provided with a first igniter 21, the inner container 20 is provided with a fire outlet pipe 22 extending from the inner cavity of the inner container 20 to the outside of the combustion chamber 10, the inner container 20 is provided with an ash discharge pipe 23 arranged above the inner container 20 and extending to the outside of the combustion chamber 10;

a feeding pipe 30 extending into the inner container 20 and feeding materials into the inner container 20;

a nozzle 60 arranged in the inner container 20 and blowing air to cause accumulated ash into the ash discharge pipe 23, a first suction fan 231 is arranged in the ash discharge pipe 23;

a gas driving mechanism 40 connected with the nozzle 60 and outputting jet gas to the nozzle 60;

an air supply mechanism 50 arranged outside the combustion chamber 10 for supplying air to the inner container 20 and the gas driving mechanism 40.

In use, air is jetted into the inner container 20 via the nozzle 60 by the gas driving mechanism 40, so that ash accumulated on the inner wall of the inner container 20 falls off, and the ash is discharged out of the combustion chamber 10 along the ash discharge pipe 23 under the suction of the first suction fan 231.

In some embodiments, the air supply mechanism 50 includes a second suction fan 51 and an air duct 52, one end of the air duct 52 is communicated with the second suction fan 51, and the other end of the air duct 52 extends into the inner container 20. The second suction fan 51 draws air from outside of the combustion chamber 10 and provides oxygen for a second igniter 44 of the inner container 20. Furthermore, a portion of the air enters the gas driving mechanism 40 to supply raw materials to the gas driving mechanism 40.

In some embodiments, there are several air ducts 52 each with a solenoid valve 521. The amount of oxygen entering the inner container 20 is controlled by opening or closing the solenoid valve 521 so as to control the combustion fire intensity.

Figure 2:
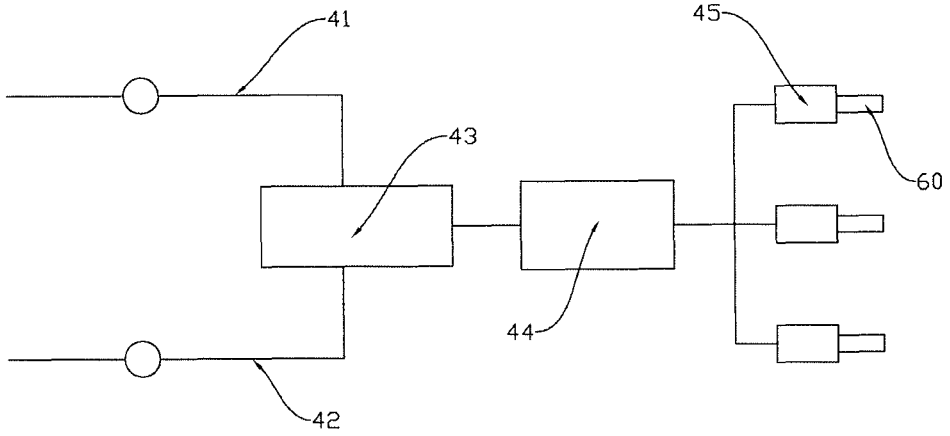
FIG. 2 is a structural schematic view of a gas driving mechanism in an embodiment of the disclosure.

In some embodiments, referring to FIG. 2, the gas driving mechanism 40 includes an air intake pipe 41, an acetylene intake pipe 42, a gas mixer 43, a second igniter 44, and a pulse generator 45, the nozzle 60 is mounted to the pulse generator 45, the air intake pipe 41 and the acetylene intake pipe 42 are respectively communicated with the gas mixer 43, the gas mixer 43 is communicated with the second igniter 44, the second igniter 44 is communicated with the pulse generator 45, and at least one of the air ducts 52 is communicated with the air intake pipe 41. The acetylene and air are mixed by the gas mixer 43 to form combustible gas, the combustible gas enters the pulse generator 45 after being ignited to form a strong-wave jet gas flow, and ash accumulated on the inner wall of the inner container 20 is strongly vibrated and falls off.

In some embodiments, there are several pulse generators 45 and several nozzles 60. The several nozzles 60 simultaneously jet gas flow to the ash on the inner container 20, so that the impact force is improved, and the ash sufficiently falls off.

In some embodiments, a heated net surface 11 is arranged in the combustion chamber 10, the heated net surface 11 abuts against the inner container 20, the inner container 20 is provided with an ash discharge opening, an inclined guide groove 12 is arranged below the heated net surface 11, the inclined guide groove 12 is arranged below the ash discharge opening, an ash collection area 13 is arranged below the ash discharge opening, and the ash collection area 13 is provided with an opening and closing gate. In the actual use, a small portion of ash cannot be driven by the first suction fan 231 out of the inner container 20, the remaining ash may fall into the ash collection area 13 along a guide rail under the action of gas flow, and the ash discharge opening is opened for treatment after production is finished.

In addition, the inner container 20 is separated from the inner wall of the combustion chamber 10 by the heated net surface 11, so that heat of the inner container 20 is prevented from being transferred to the wall of the combustion chamber 10 to affect parts or equipment near the combustion chamber 10. Moreover, the arrangement of net surface also facilitates for ash to fall off.

Embodiments of the disclosure have been described in detail above with reference to the accompanying drawings, but the disclosure is not limited to the above-described embodiments, and various changes can be made without departing from the principle of the disclosure within the knowledge of those skilled in the art.

What is claimed is:

1. A combustion mechanism comprising:

a combustion chamber;

an inner container arranged in the combustion chamber, the inner container including:

a first igniter within the inner container;

a fire outlet pipe extending from an inner cavity of the inner container to outside of the combustion chamber;

an ash discharge pipe above the inner container and extending to outside of the combustion chamber;

a first suction fan being arranged in the ash discharge pipe;

a feeding pipe extending into the inner container, the feeding pipe being configured to feed materials into the inner container;

a nozzle in the inner container, the nozzle being configured to blow air to cause accumulated ash into the ash discharge pipe;

a gas driving mechanism connected with the nozzle, the gas driving mechanism being configured to output gas to the nozzle; and an air supply mechanism outside the combustion chamber, the air supply mechanism being configured to supply air to the inner container and the gas driving mechanism.

2. The combustion mechanism according to claim 1, wherein the air supply mechanism comprises a second suction fan, and an air duct with one end communicated with the second suction fan and the other end extending into the inner container.

3. The combustion mechanism according to claim 2, wherein the air supply mechanism comprises several air ducts respectively with a solenoid valve.

4. The combustion mechanism according to claim 3, wherein the gas driving mechanism comprises an air intake pipe, an acetylene intake pipe, a gas mixer, a second igniter and a pulse generator, the nozzle is mounted to the pulse generator, the air intake pipe and the acetylene intake pipe are respectively communicated with the gas mixer, the gas mixer is communicated with the second igniter, the second igniter is communicated with the pulse generator, and at least one of the air ducts is communicated with the air intake pipe.

5. The combustion mechanism according to claim 4, wherein several pulse generators and several nozzles are provided.

6. The combustion mechanism according to claim 1, wherein the combustion chamber is internally provided with a heated net surface which abuts against the inner container, the inner container is provided with an ash discharge opening, and wherein an inclined guide groove is arranged below the heated net surface, the inclined guide groove is arranged below the ash discharge opening, an ash collection area with an opening and closing gate is arranged below the ash discharge opening.

7. A combustion mechanism comprising:

a combustion chamber;

an inner container arranged in the combustion chamber, the inner container including:

a first igniter within the inner container;

a fire outlet pipe extending from an inner cavity of the inner container to outside of the combustion chamber;

an ash discharge pipe above the inner container and extending to outside of the combustion chamber;

a first suction fan being arranged in the ash discharge pipe;

a feeding pipe extending into the inner container, the feeding pipe being configured to feed materials into the inner container;

a nozzle in the inner container, the nozzle being configured to blow air to cause accumulated ash into the ash discharge pipe;

a gas output connected with the nozzle, the gas output being configured to output gas to the nozzle; and an air duct outside the combustion chamber, the air duct being configured to supply air to the inner container.

8. The combustion mechanism according to claim 7, further comprising:

an air supply mechanism including a second suction fan, and the air duct with one end communicated with the second suction fan and the other end extending into the inner container.

9. The combustion mechanism according to claim 8, wherein the air supply mechanism comprises several air ducts respectively with a solenoid valve.

10. The combustion mechanism according to claim 7, further comprising:

a gas driving mechanism including the gas output, an air intake pipe, an acetylene intake pipe, a gas mixer, a second igniter and a pulse generator;

wherein the nozzle is mounted to the pulse generator, the air intake pipe and the acetylene intake pipe are respectively communicated with the gas mixer, the gas mixer is communicated with the second igniter, the second igniter is communicated with the pulse generator, and the air duct is communicated with the air intake pipe.

11. The combustion mechanism according to claim 10, wherein several pulse generators and several nozzles are provided.

12. The combustion mechanism according to claim 7, wherein the combustion chamber is internally provided with a heated net surface which abuts against the inner container, the inner container is provided with an ash discharge opening, and wherein an inclined guide groove is arranged below the heated net surface, the inclined guide groove is arranged below the ash discharge opening, an ash collection area with an opening and closing gate is arranged below the ash discharge opening.

13. A combustion mechanism comprising:

a combustion chamber;

an inner container arranged in the combustion chamber, the inner container including:

a fire outlet pipe extending from an inner cavity of the inner container to outside of the combustion chamber;

an ash discharge pipe above the inner container and extending to outside of the combustion chamber;

a first suction fan being arranged in the ash discharge pipe;

a feeding pipe extending into the inner container, the feeding pipe being configured to feed materials into the inner container;

a nozzle in the inner container, the nozzle being configured to blow air to cause accumulated ash into the ash discharge pipe;

a gas output connected with the nozzle, the gas output being configured to output gas to the nozzle; and an air duct outside the combustion chamber, the air duct being configured to supply air to the inner container.

14. The combustion mechanism according to claim 13, further comprising:

an air supply mechanism including a second suction fan, and the air duct with one end communicated with the second suction fan and the other end extending into the inner container.

15. The combustion mechanism according to claim 14, wherein the air supply mechanism comprises several air ducts respectively with a solenoid valve.

16. The combustion mechanism according to claim 13, further comprising:

a first igniter within the inner container; and a gas driving mechanism including the gas output, an air intake pipe, an acetylene intake pipe, a gas mixer, a second igniter and a pulse generator;

wherein the nozzle is mounted to the pulse generator, the air intake pipe and the acetylene intake pipe are respectively communicated with the gas mixer, the gas mixer is communicated with the second igniter, the second igniter is communicated with the pulse generator, and the air duct is communicated with the air intake pipe.

17. The combustion mechanism according to claim 16, wherein several pulse generators and several nozzles are provided.

18. The combustion mechanism according to claim 13, wherein the combustion chamber is internally provided with a heated net surface which abuts against the inner container, the inner container is provided with an ash discharge opening, and wherein an inclined guide groove is arranged below the heated net surface, the inclined guide groove is arranged below the ash discharge opening, an ash collection area with an opening and closing gate is arranged below the ash discharge opening.

* * * * *